US005291227A

United States Patent [19]

Suzuki

[11] Patent Number: 5,291,227

[45] Date of Patent: Mar. 1, 1994

[54] INK JET PRINTER HAVING IMPROVED PAPER TRANSPORT MECHANISM

[75] Inventor: Shigeru Suzuki, Yokohama, Japan

[73] Assignee: Ricoh Company, Ltd., Tokyo, Japan

[21] Appl. No.: 881,460

[22] Filed: May 11, 1992

[30] Foreign Application Priority Data

May 17, 1991 [JP] Japan ..... 3-141342

[51] Int. Cl.[5] ..... B41J 11/02; B41J 2/01

[52] U.S. Cl. ..... 346/140 R

[58] Field of Search ..... 346/140 R, 76 PH, 138; 400/662

[56] References Cited

U.S. PATENT DOCUMENTS 4,849,772 7/1989 Tenbroeck et al. ..... 346/139 R
4,910,530 5/1990 Fukumoto et al. ..... 346/76 PH
4,992,805 2/1991 Yoshizawa et al. ..... 346/134

FOREIGN PATENT DOCUMENTS 0086274 5/1986 Japan ..... 346/76 PH
0373352 3/1991 Japan ..... B41J 2/165

*Primary Examiner*—Benjamin R. Fuller
*Assistant Examiner*—N. Le
*Attorney, Agent, or Firm*—Cooper & Dunham

[57] ABSTRACT

An ink jet printer includes paper supply rollers for supplying a paper, paper eject rollers for ejecting the paper supplied from the paper supply rollers, where the paper is transported along a paper transport direction in an approximately plane paper supply path between the paper supply and eject rollers, a nozzle for ejecting ink on the paper in a printing region between the paper supply and eject rollers, and a guide part for guiding the paper between the paper supply and eject rollers. A gap is formed between the guide part and the paper which is simultaneously transported by both the paper supply and eject rollers at least within the printing region. The gap decreases in the paper transport direction towards the paper eject rollers.

17 Claims, 2 Drawing Sheets

INK JET PRINTER HAVING IMPROVED PAPER TRANSPORT MECHANISM

BACKGROUND OF THE INVENTION

The present invention generally relates to ink jet printers, and more particularly to an ink jet printer which prints information on a paper by adhering on the paper an ink which is ejected from a nozzle having an ejection hole with an extremely small diameter.

Printers can roughly be categorized into impact type printers and non-impact type printers. The impact type printer includes wire dot printers and thermal transfer printers which print images directly on the paper. On the other hand, the non-impact type printers include ink jet printer which print images without making direct contact with the paper.

In the wire dot printers and the thermal transfer printers, the paper is fed to a platen roller and the images are printed on the paper which is located on the platen roller. The transport direction of the paper is changed approximately 180° to make a U-turn by the platen roller, so that the paper is positively transported to the target position.

The printers which use the platen roller can be made relatively compact because only simple parts are required. However, there is a problem in that such printers are not suited for printing images on a thick paper or an envelope, because it is difficult to positively make the thick paper and the envelope make the U-turn at the platen roller. For this reason, printers have been proposed in which the U-turn of the thick paper and the envelope is avoided by providing an independent linear paper supply path. This linear paper supply path supplies the thick paper and the envelope to a printing part of the printer in an approximately linear path without the need for the thick paper and the envelope to make the U-turn.

On the other hand, the ink jet printer prints images on the paper by ejecting droplets of an ink which is ejected from a nozzle. Since the printing part of the ink jet printer does not need to make direct contact with the paper, it is unnecessary to provide the platen. In other words, the images can be printed on the paper in a linear paper supply path.

However, in the ink jet printer, a gap between the nozzle of the printing part and the paper must always be maintained constant. For this reason, measures must be taken so that this gap is maintained constant, and a method of transporting the paper through the printing part without slack is one of such measures which are conventionally taken.

If the ink ejected from the nozzle spreads in a range in which the paper does not exist in a direction taken along the width of the paper, the ink will adhere to a guide member which is provided within this range to guide the paper. As a result, when the paper having a greater width is next transported, the ink adhered on the guide member will stain this wider paper. For this reason, it is desirable to restrict the ink ejection region.

The ink ejection region (or the printing region) can be restricted with ease in the paper transport direction by providing sensors along the transport path, for example. However, it is difficult to restrict the ink ejection region in a paper width direction which is perpendicular to the paper transport direction, because it is difficult to detect all of the various paper widths and appropriately adjust the ink ejection region for each detected paper width.

Therefore, the ink ejection region in the paper width direction is set in accordance with the maximum width of paper used by taking into consideration the printing on the paper having the maximum width. But if the printing is made using the paper having a width smaller than the maximum width, the ink is ejected to parts where no paper exist as described above, and the paper which is transported thereafter will be stained by such ink.

The ink which is adhered on the parts such as the guide member described above cannot be cleaned in a simple manner, unlike the cleaning of the platen roller using a cleaning liquid and the like.

SUMMARY OF THE INVENTION

Accordingly, it is a general object of the present invention to provide a novel and useful ink jet recording apparatus in which the problems described above are eliminated.

Another object of the present invention is to provide an ink jet printer which can positively transport a printing medium to a predetermined printing position regardless of whether the printing medium is a thin paper or a thick paper, and can prevent the printing medium from being stained by the ink.

Still another object of the present invention is to provide an ink jet printer in which a paper jam and a dog-ear are prevented even if the paper is fed with a skew.

A further object of the present invention is to provide an ink jet printer in which a peripheral part of a printing part is prevented from being stained by the ejected ink.

Another and more specific object of the present invention is to provide an ink jet printer comprising first roller means for supplying a paper, second roller means for ejecting the paper supplied from the first roller means, where the paper is transported along a paper transport direction in an approximately plane paper supply path between the first and second roller means, a nozzle for ejecting ink on the paper in a printing region between the first and second roller means, and guide means for guiding the paper between the first and second roller means, where a gap is formed between the guide means and the paper which is simultaneously transported by both the first and second roller means at least within the printing region, and the gap decreases in the paper transport direction towards the second roller means. According to the ink jet printer of the present invention, it is possible to positively transport the paper regardless of the thickness and size of the paper, and thus guarantee an image to be printed at a predetermined position on the paper. In addition, even if the ink adheres on the guide means during the printing and a larger paper is thereafter used for the next printing, it is possible to prevent the next larger paper from being stained by the ink on the guide means.

Other objects and further features of the present invention will be apparent from the following detailed description when read in conjunction with the accompanying drawings.

DESCRIPTION OF THE PREFERRED EMBODIMENTS

Figure 1:
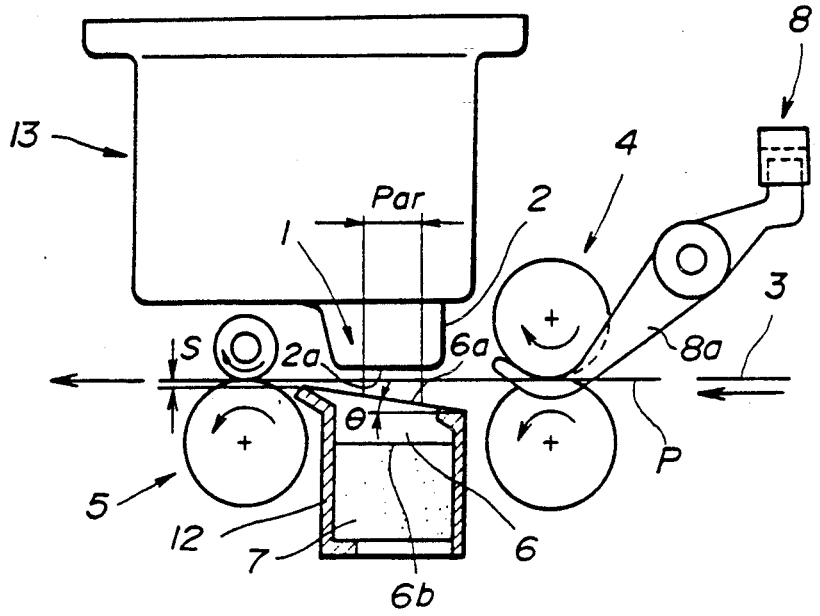
FIG. 1 is a side view in cross section generally showing an essential part of an embodiment of an ink jet printer according to the present invention in a vicinity of a printing part.

FIG. 1 generally shows a peripheral part of a printing part which forms an essential part of an embodiment of an ink jet printer according to the present invention.

The ink jet printer shown in FIG. 1 is provided with a nozzle 2 which has an ejection hole 2*a* having an extremely small diameter in a lower surface thereof. An ink which is stored within an ik cartridge 13 is ejected from the ejection hole 2*a* of the nozzle 2. A paper P is transported in a paper supply path 3 along a direction A, and the ejected ink from the nozzle 2 is transferred to a predetermined position on the top surface of the paper P which reaches a printing part 1. The transferred ink on the paper P forms a character and the like.

A printing region $P_{ar}$ in which the printing is made by adhering the ink ejected from the nozzle 2 onto the paper P which is transported to the printing part 1, is formed within the paper supply path 3 which is an approximate plane. A pair of upper and lower paper supply rollers 4 are provided on the upstream side of nozzle 2 along the paper transport direction A. A pair of upper and lower paper eject rollers 5 are provided on the downstream side of the nozzle 2 along the paper transport direction A. The upper and lower paper supply rollers 4 press against each other, while the upper and lower paper eject rollers 5 similarly press against each other.

Figure 2:
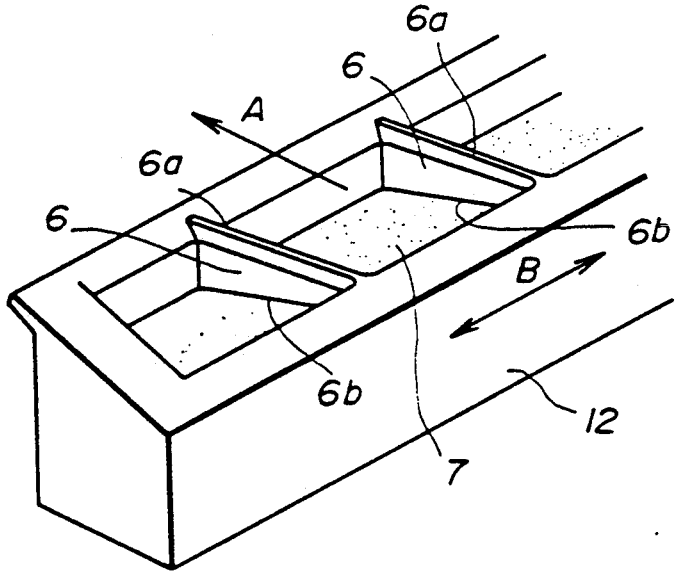
FIG. 2 is a perspective view showing a plurality of guide members fixed within a casing which is provided on the printing part.

As shown in FIG. 2, a plurality of fin shaped guide members 6 for guiding the tip end of the paper P are fixed within a casing 12 at predetermined intervals along a direction B which is approximately perpendicular to the paper transport direction A. The width of the paper P is taken along this direction B. The casing 12 is provided between the paper supply rollers 4 and the paper eject rollers 5, and guide surfaces 6*a* of the guide members 6 are separated from the paper P which is transported between the paper supply rollers 4 and the paper eject rollers 5 at least within the printing region $P_{ar}$. The guide members 6 are respectively inclined by an angle $\theta$ so that a gap S between the bottom surface of the paper P and each guide surface 6*a* decreases towards the downstream side.

Figure 3:
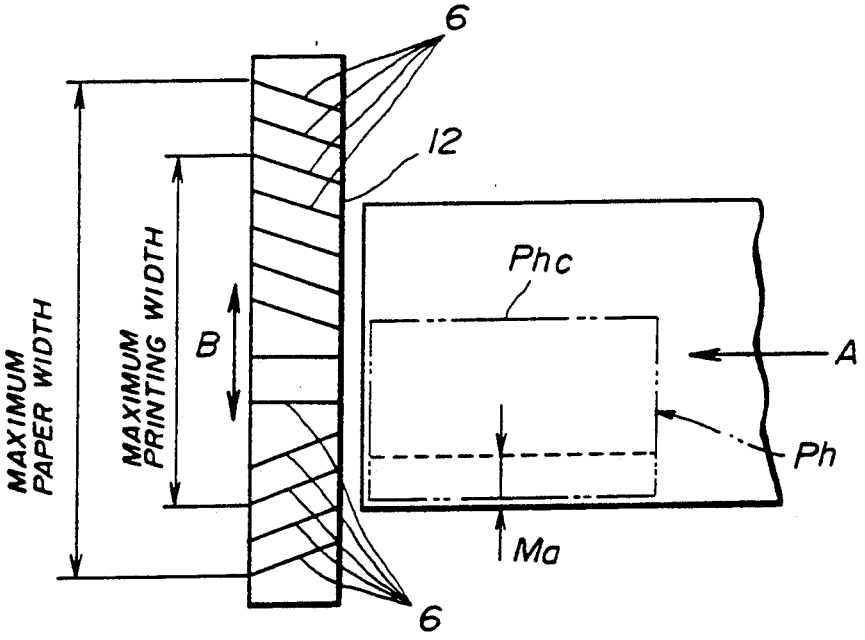
FIG. 3 is a plan view for explaining the mounting angle of the guide members relative to the paper transport direction.

As shown in FIG. 3, predetermined guide members 6 located on the outer side along the paper width direction B are inclined to the outside relative to the paper transport direction A, so that the corresponding guide surfaces 6*a* of the predetermined guide members 6 are inclined to the outside as shown in FIG. 2.

As shown in FIG. 1, an ink absorbing member 7 is provided at a lower end part 6*b* of each guide member 6 opposite from the guide surface 6*a* for a range which exceeds the printing region $P_{ar}$. Each lower end part 6*b* makes contact with the corresponding ink absorbing member 7.

For example, the ink absorbing member 7 is made of a continuous foam made of a resin, a fiber material such as that use for a filter of a cigarette and the like.

In this embodiment, the paper supply rollers 4 function as resist rollers. A sensor 8 is provided in a vicinity of a nip part of the paper supply rollers 4. The sensor 8 detects the passing paper P when a feeler 8*a* thereof is pushed by the paper P which is transported in the paper supply path 3 towards the printing part 1 in the paper transport direction A. The timing with which the paper P is transported and the timing with which the image is printed are synchronized based on the detection of the sensor 8.

The supply of the paper P is started by inserting the paper P into a paper inserting opening (not shown) which is located on the right hand side of a main body of the printer in FIG. 1. The paper supply rollers 4 and the paper eject rollers 5 respectively rotate in the directions of the arrows in FIG. 1 when the paper supply starts, and the inserted paper P is supplied in the paper supply path 3 in the paper transport direction A. The tip end of the paper P swings the feeler 8*a* of the sensor 8 clockwise and the sensor 8 accordingly detects the inserted paper P.

As the tip end of the paper P passes the printing part 1 and reaches the nip part of the paper eject rollers 5, a tension is introduced in the paper P between the paper supply rollers 4 and the paper eject rollers 5 due to a difference in the peripheral velocities of the paper supply rollers 4 and the paper eject rollers 5. The peripheral velocity of the paper eject rollers 5 is preset to be slightly faster than that of the paper supply rollers 4. For this reason, no slack is introduced in the paper P between the paper supply rollers 4 and the paper eject rollers 5, and the paper P forms a plane between the paper supply rollers 4 and the paper eject rollers 5.

A one-wa clutch (not shown) is provided between the paper supply roller 4 and a support shaft thereof. Hence, the paper supply roller 4 starts to rotate in the direction of the arrow in FIG. 1 when the paper P is transported in the paper transport direction A at the peripheral velocity of the paper eject roller 5, and the paper P can be transported smoothly by the paper eject rollers 5.

The pressing forces and the coefficients of friction of the paper supply rollers 4 and the paper eject rollers 5 are set so that the paper P can be transported without generating a slack between the paper supply roller 4 and the paper eject roller 5.

Therefore, the ink is ejected from the nozzle 2 onto the paper P which is provided under tension at the printing part 1 between the paper supply rollers 4 and the paper eject rollers 5, and a predetermined image is printed on the paper P.

In order to positively transport the tip end of the paper P by the transport force of the paper supply rollers 4 to the nip part of the paper eject rollers 5 so that no paper jam or the like is generated, it is necessary to provide a guide member for guiding the tip end of the paper P to the nip part of the paper eject rollers 5.

However, such a guide member would be provided in the printing region $P_{ar}$ between the paper supply rollers 4 and the paper eject rollers 5 in FIG. 1 in order to carry out its function. For this reason, the ink which is ejected from the nozzle 2 may be ejected outside the region of the paper P in the width direction B and adhere to parts of the ink jet printer in this region.

As a result, if a paper $P_h$ having the size of a post card as shown in FIG. 3 is first used for the printing and a paper having a maximum width usable in this ink jet printer is thereafter supplied for the next printing, the tip end of this paper would be guided by the guide member on which the ink is adhered during the previous printing to the paper $P_h$, and this paper would be stained by the ink.

However, in this embodiment, the guide surface 6a of each guide member 6 is inclined by the angle $\theta$ as shown in FIG. 1 so that the guide surface 6a inclines upwardly towards the paper transport direction A. In addition, the gap S between the bottom surface of the paper P which is transported and the guide surface 6a decreases towards the downstream side along the paper transport direction A. Therefore, the paper P can be positively guided to the nip part of the paper eject rollers 5 essentially without the possibility of staining the paper P by the ink adhered to the guide member 6 during the previous printing.

In other words, when the paper P is transported to the printing region $P_{ar}$ in this ink jet printer, the tip end of the paper P hangs slightly downward after passing the paper supply rollers 4. The paper P is transported in this state or, only the tip end of the paper P makes contact with and is guided by the sloped guide surfaces 6a of the guide members 6, and the paper P reaches the nip part of the paper eject rollers 5.

When the tip end of the paper P reaches the nip part of the paper eject rollers 5 and the paper P becomes pinched between and transported by both the paper supply rollers 4 and the paper eject rollers 5, a tension is generated in the paper P between the paper supply rollers 4 and the paper eject rollers 5 because of the difference in the peripheral velocities of the paper supply rollers 4 and the paper eject rollers 5. Accordingly, the paper P is transported in the paper transport direction A in a state where the gap S is formed between the bottom surface of the paper P and the guide surfaces 6a of the guide members 6.

Therefore, even if the paper P which is supplied next passes the part of the guide surface 6a on which the ink ejected from the nozzle 2 is adhered during the previous printing and which belongs to the guide member 6 located on the outer side along the paper width direction B, only the tip end part of this next paper P is guided by each guide member located at the outer side along the paper width direction B, and stain on this next paper P does not become a problem even if the tip end part thereof makes contact with the guide surface 6a of such guide member 6.

In this embodiment, the guide surface 6a of each guide member 6 has a fin shape as shown in FIG. 2. For this reason, the paper P does not make contact with a large area of the guide member 6 (or guide surface 6a). In other words, only an extremely narrow strip of the guide member 6 actually makes contact with the bottom surface of the paper P, and the paper P is uneasily stained by the ink adhered on the guide member 6.

Furthermore, in this embodiment, the guide surface 6a of each guide member 6 located on the outer side along the paper width direction B is inclined to the outer side relative to the paper transport direction A, as described in conjunction with FIG. 3. Hence, it is possible to positively prevent a dog-ear from being formed at the tip end of the paper P when the tip end of the paper P makes contact with the guide member 6, even when the paper P is supplied with a skew. In addition, a paper jam is also prevented.

The ink jet printer may be capable of changing the reference position for the paper P along the paper width direction B from the standard leftmost reference position in order to provide a left margin MA as shown in FIG. 3. In this case, it is effective to provide the guide members 6 so that the guide surfaces 6a are inclined to the outer side also on the left side along the paper transport direction A as shown in FIG. 3.

When providing the guide members 6 on the right side along the paper transport direction A, the position of a right end $P_{hc}$ of the post card $P_h$ having the minimum paper size used may be regarded as the reference position. In other words, it is preferable that all of the guide members 6 on the outer side of the right end $P_{hc}$ are arranged approximately at a constant interval with the inclination described above.

Inside the casing 12 on the lower side of the guide surfaces 6a of the guide members 6 shown in FIG. 1, the ink absorbing member 7 is provided for a range exceeding the printing region $P_{ar}$ and the ink absorbing member 7 makes contact with the end parts 6b of the guide members 6 on the opposite side (lower side) of the guide surfaces 6a as shown in FIG. 2. Hence, the ejected ink which adheres on the guide members 6 can be recovered by the ink absorbing member 7, and it is possible to prevent parts of the ink jet printer other than the paper P from being stained by the ink which is ejected from the nozzle 2.

Moreover, since the printing region $P_{ar}$ is formed within the paper supply path 3 which is an approximate plane, it is possible to positively transport the paper and print the image at a predetermined position of the paper even if the paper is unsuited for being transported in a non-linear transport path, such as the case where the paper is thick.

The ink cartridge 13 in which the ink is filled may be provided movable in the paper width direction B. In this case, the ink cartridge 13 is moved together with the nozzle 2 to an approximate center of the paper P along the paper width direction during the time in which the tip end of the paper P is transported from the paper supply rollers 4 to the nip part of the paper eject rollers 5.

Further, the present invention is not limited to these embodiments, but various variations and modifications may be made without departing from the scope of the present invention.

What is claimed is:

1. An ink jet printer comprising:

first roller means for supplying a paper;

second roller means for ejecting the paper supplied from said first roller means, said paper being transported along a paper transport direction in an approximately plane paper supply path between said first and second roller means;

a nozzle for ejecting ink on the paper in a printing region between said first and second roller means; and guide means for guiding the paper between said first and second roller means, said guide means and said nozzle being located on mutually opposite sides relative to the paper, a gap being formed between said guide means and the paper which is simultaneously transported by both said first and second roller means at least within the printing region, said gap decreasing in the paper transport direction towards said second roller means.

2. The ink jet printer as claimed in claim 1, wherein a peripheral velocity of said second roller means is set slightly faster than that of said first roller means.

3. The ink jet printer as claimed in claim 1, wherein the guide means does not normally make contact with the paper.

4. An ink jet printer comprising:

first roller means for supplying a paper;

second roller means for ejecting the paper supplied from said first roller means, said paper being transported along a paper transport direction in an approximately plane paper supply path between said first and second roller means;

a nozzle for ejecting ink on the paper in a printing region between said first and second roller means; and guide means for guiding the paper between said first and second roller means, a gap being formed between said guide means and the paper which is simultaneously transported by both said first and second roller means at least within the printing region, said gap decreasing in the paper transport direction towards said second roller means;

wherein said guide means includes a plurality of fins which are arranged in a predetermined direction approximately perpendicular to the paper transport direction.

5. The ink jet printer as claimed in claim 4, wherein the fins provided in vicinities of two opposite ends of said guide means are inclined and extend outwardly relative to the paper transport direction.

6. An ink jet printer comprising:

first roller means for supplying a paper;

second roller means for ejecting the paper supplied from said first roller means, said paper being transported along a paper transport direction in an approximately plane paper supply path between said first and second roller means;

a nozzle for ejecting ink on the paper in a printing region between said first and second roller means; and guide means for guiding the paper between said first and second roller means, a gap being formed between said guide means and the paper which is simultaneously transported by both said first and second roller means at least within the printing region, said gap decreasing in the paper transport direction towards said second roller means;

wherein said guide means includes an ink absorbing member for absorbing the ink ejected from said nozzle.

7. The ink jet printer as claimed in claim 6, wherein the ink absorbing member is provided in a range exceeding the printing region.

8. The ink jet printer as claimed in claim 6, wherein said guide means includes a plurality of fins which are arranged in a predetermined direction approximately perpendicular to the paper transport direction.

9. The ink jet printer as claimed in claim 6, wherein the fins make contact with the ink absorbing member.

10. The ink jet printer as claimed in claim 9, wherein the fins provided in vicinities of two opposite ends of said guide means are inclined and extend outwardly relative to the paper transport direction.

11. The ink jet printer as claimed in claim 8, wherein the fins provided in vicinities of two opposite ends of said guide means are inclined and extend outwardly relative to the paper transport direction.

12. An ink jet printer comprising:

first roller means for supplying a paper;

second roller means for ejecting the paper supplied from said first roller means, said paper being transported along a paper transport direction in an approximately plane paper supply path between said first and second roller means;

a nozzle for ejecting ink on the paper in a printing region between said first and second roller means; and guide means for guiding the paper between said first and second roller means, a gap being formed between said guide means and the paper which is simultaneously transported by both said first and second roller means at least within the printing region, said gap decreasing in the paper transport direction towards said second roller means;

wherein said guide means includes a casing having an opening defined by top edge parts thereof, and a plurality of guide members traversing the opening generally along the paper transport direction, each of said guide members having a top surface which forms a guide surface together with the top edge parts of the casing, said gap being defined as a distance between the guide surface and a surface of the paper closer to said guide means.

13. The ink jet printer as claimed in claim 12, wherein the guide members are arranged in the form of fins at a predetermined interval in a direction approximately perpendicular to the paper transport direction.

14. The ink jet printer as claimed in claim 12, wherein the guide members provided in vicinities of two opposite ends of said casing are inclined and extend outwardly relative to the paper transport direction.

15. The ink jet printer as claimed in claim 12, wherein said guide means includes an ink absorbing member accommodated within the casing for absorbing the ink ejected from said nozzle.

16. The ink jet printer as claimed in claim 15, wherein the guide members make contact with the ink absorbing member.

17. The ink jet printer as claimed in claim 15, wherein the ink absorbing member is provided in a range exceeding the printing region.

* * * * *